US006216395B1

(12) United States Patent
Kelly

(10) Patent No.: US 6,216,395 B1
(45) Date of Patent: Apr. 17, 2001

(54) THRESHOLD PROTECTIVE COVER

(76) Inventor: Donald R. Kelly, P.O. Box 48282, Watauga, TX (US) 76148

( * ) Notice: Subject to any disclaimer, the term of this patent is extended or adjusted under 35 U.S.C. 154(b) by 0 days.

(21) Appl. No.: 09/247,798

(22) Filed: Feb. 8, 1999

(51) Int. Cl.[7] ..... E06B 1/70
(52) U.S. Cl. ..... 49/467; 52/3; 52/DIG. 12
(58) Field of Search ..... 52/716.1, 716.2, 52/717.01, 718.01, 730.3, 741.3, 211, 181, 105, 179, DIG. 12, 515, 3; 49/467

(56) References Cited

U.S. PATENT DOCUMENTS

| | | | |
|---|---|---|---|
| 588,626 | 8/1897 | Baumann . | |
| 767,615 | 8/1904 | Webber . | |
| 1,348,396 | 8/1920 | Dubee . | |
| 1,543,034 | 6/1925 | Stevens . | |
| 1,966,402 | 7/1934 | Barringer | 20/64 |
| 2,132,471 | 10/1938 | Hoffman | 280/163 |
| 2,722,724 | 11/1955 | Miller | 20/64 |
| 2,872,714 * | 2/1959 | Odegaard et al. . | |
| 2,999,280 | 9/1961 | Miller | 20/64 |
| 3,130,455 * | 4/1964 | Borlenghi . | |
| 3,667,164 * | 6/1972 | Coppins . | |
| 4,079,550 * | 3/1978 | Bursk et al. . | |
| 4,492,062 | 1/1985 | Levenez | 52/97 |
| 4,907,387 * | 3/1990 | Turnbull . | |
| 4,923,348 | 5/1990 | Carlozzo | 411/377 |
| 4,956,940 | 9/1990 | Touton, III | 49/388 |
| 5,148,644 * | 9/1992 | Weir . | |
| 5,249,399 * | 10/1993 | Aulson . | |
| 5,588,266 * | 12/1996 | Headrick . | |
| 5,611,173 * | 3/1997 | Headrick et al. . | |
| 5,673,517 | 10/1997 | Stanclift | 49/468 |
| 6,044,600 * | 4/2000 | McCollough . | |

* cited by examiner

*Primary Examiner*—Robert Canfield

(57) ABSTRACT

A threshold protector to be used during the construction of a house or building is an apparatus made of durable material covering the threshold, contacting the back and front of the threshold and removably attached to the threshold.

16 Claims, 2 Drawing Sheets

THRESHOLD PROTECTIVE COVER

FIELD OF THE INVENTION

The present invention is directed, in general, to a protective covering for the thresholds of doorways in houses or buildings under construction.

BACKGROUND OF THE INVENTION

During the construction of houses and buildings doorframes are installed in the building at an early stage. After installation, workers tread upon the threshold in shoes or boots, that carry mortar, dirt and rocks on the soles, Workers wheel or drag equipment into the house or building subjecting the threshold to scraping and impact. Bricks may be placed on the threshold or fall onto the threshold by workmen installing the exterior brick. Mortar, paint and chemicals, such as lacquer or thinner, can drip onto the threshold during varying phases of construction resulting in discoloration or damage. During the acid wash of the exterior brick, hydrochloric acid can fall onto the threshold causing additional discoloration or damage.

Removing dirt, rocks, mortar, paint, thinner, lacquer or acid discoloration from the threshold of a doorway takes one worker from fifteen to thirty minutes per doorway. In a typical residential construction with three doorways, three quarters of one man hour to one and one-half man hours of labor are required for the clean-up. Moreover, the clean-up work cannot remove scratches or dents. If a drop cloth is thrown over the threshold, it may not stay in place, or it will wear out before the construction is completed. More importantly, a drop cloth will be a hazard for workers who may trip over the loose material thereby causing increased expenses through on the job injuries and lost time. Putting tape on the threshold requires a good deal of time and will not survive the entire construction cycle due to the traffic and loads to be borne. Therefore, a need exists for an inexpensive disposable threshold protector that will have sufficient durability to last the entire construction period of the house or building.

Additionally, protection of thresholds is beneficial during moving of furniture, installation of new doors and during remodeling of existing buildings.

The prior art does not disclose such a protector. There are many examples of thresholds; however, no device has been patented to provide for the protection of the threshold during the construction of the house or building. U.S. Pat. No. 4,492,062 to Levenez discloses a window sill assembly for protecting and covering an existing window sill at the base of the window. The device is meant for permanent installation and is not adaptable to door thresholds.

SUMMARY OF THE INVENTION

A threshold protector to be used during the construction of a house or building is an apparatus made of durable material covering the threshold, contacting the back and front of the threshold and removably attached to the threshold.

BRIEF DESCRIPTION OF THE DRAWINGS

The apparatus of the invention is further described and explained in relation to the following figures of the drawings wherein.

DESCRIPTION OF PREFERRED EMBODIMENTS

In the discussion of the figures, the same numbers will be used to refer to the same or similar components throughout. The term threshold as used herein is defined as the plank, timber, metal piece or stone lying under the door of a building and as used herein has the same meaning as the term doorsill which is defined as the horizontal lower member of a door casing. Adhesive tape is defined as a piece or strip of paper, fabric, vinyl, or metal coated with an adhesive substance such as a glue or paste capable of adhering to a range of surfaces such as wood, metal, plastic, vinyl or stone. By double sided adhesive tape is meant tape with adhesive on a side that can be affixed to one surface and another side that can be affixed to a second surface. By adhering is meant the ability to stick fast or together while allowing removal without damage to the surface to which the adhesive is applied. By covering is meant placing something over or upon the threshold for the purpose of protecting the threshold. By doorway is meant a passage for entrance and exit into and out of a house, building or room wherein the doorway contains a door and door frame used for closing or opening the passage.

Figure 1:
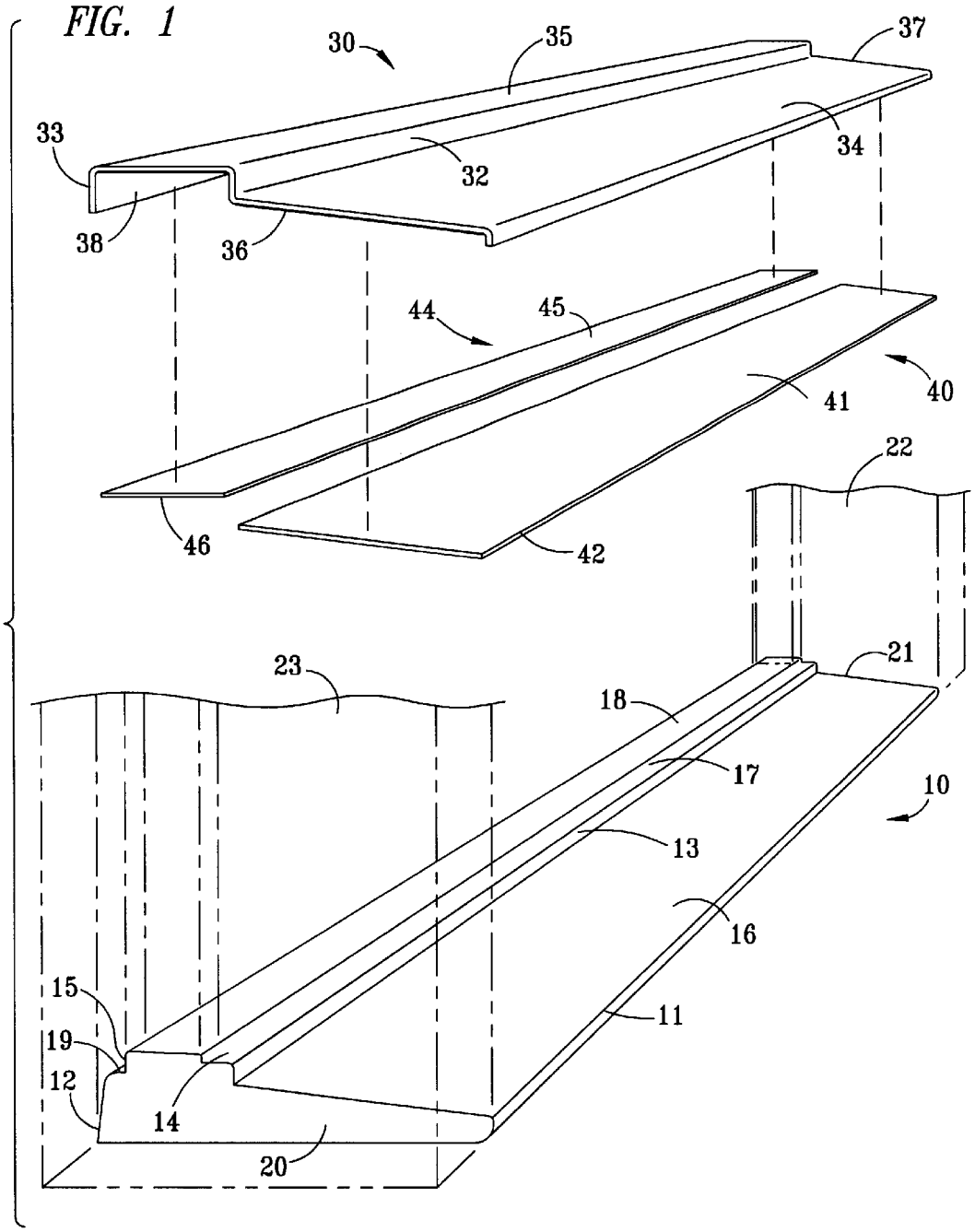
FIG. 1 is an exploded view of the apparatus, the two side adhesive tape, and the doorway threshold.

According to the present invention, FIG. 1 depicts threshold 10. Threshold 10 has front edge 11 and rear edge 12. Left side 20 and right side 21 are fixedly engaged with left door frame 23 and right door frame 24. Threshold 10 has main step 16, first minor step 17, door step 18 and second minor step 19. Threshold 10 further has first face 13, second face 14 and third face 15. First minor step 17, door step 18, second minor step 19 first face 13, second face 14 and third face 15 define the area of threshold 10 which is aligned underneath the door to be rotatably engaged with either left door frame 23 or right door frame 22.

FIG. 1. further depicts first cover 30. First cover 30 has front flange 31, first top section 34, vertical section 32, second top section 35 and rear flange 33. First cover 30 has first side 36 and second side 37. First cover 30 has bottom surface 38.

First cover 30 is made of molded plastic, polyurethane, polyvinyl chloride, rubber, wood, cardboard or any suitable commercially available material capable of being molded into a single unitary piece. First cover 30 can be made from any material which has the characteristics of durability and resiliency to dirt, water, chemicals, abrasion and impact. In the preferred embodiment, first cover 30 is manufactured in a mold so that there are no seams or breaks between the various sections. Alternatively, first cover 30 could be heat pressed from a single sheet of plastic or synthetic material. First cover 30 could also be stamped or pressed from a single piece of metal. As a further alternative first cover 30 could be assembled by spot welding, gluing or taping.

First cover 30 is of uniform thickness of 0.094 inches throughout. The thickness of first cover 30 can be from 1/16 inch to ¼ inch. Front flange 31 extends 0.233 inches from first sheet end 48 to the curve where front flange 31 becomes first top section 34. The radius of curvature between front flange 31 and first top section 34 is 0.125 inches. The angle between front flange 31 and first top section 34 is 96.5 degrees. First top section 34 rises at an angle of 6.5 degrees for a distance of 4.00 inches until it becomes vertical section 32. The angle between first top section 34 and vertical section 32 is 96.5 degrees. Vertical section 32 extends for 0.25 inch until it becomes second top section 35. The angle between first vertical section 35 and second top section 35 is 90 degrees. Second top section 35 extends for 2.188 inches until it becomes rear flange 33. The radius of curvature between rear flange 33 and second top section 35 is 0.125 inches. The angle between second top section 35 and rear flange 33 is 90 degrees. Rear flange 33 extends for 0.719 inches until first cover 30 terminates in second sheet end 49. The overall width of first cover 30 from front flange 31 to rear flange 33 is 6.188 inches. The length of first cover 30 measured from first side 36 to second side 37 is 35 inches for first cover 30's manufactured for front door thresholds and 31 inches for first cover 30's manufactured for garage door, rear door and utility door thresholds. However, the length of first cover 30 can be up to 48 inches for custom doors. For front door threshold's the width of first cover 30 measured from front flange 31 to rear flange 33 can vary from 3 inches to 10 inches. For garage door, rear door and utility door thresholds, the width of first cover 30 measured from front flange 31 to rear flange 33 can vary from 2 inches to 6 inches. The height of front flange 31 can vary from ⅛ inch to ½ inch. The height of rear flange 33 can vary from ¼ inch to 1 inch.

First cover 30 can function to protect the threshold by aligning first cover 30 above threshold 10 and lowering first cover 30 onto threshold 10 so that front flange 31 contacts front edge 11 of threshold 10 and rear flange 33 contacts rear edge 12 of threshold 10. First cover 30 will be held in place by gravity.

First cover 30 can be made more secure by means of adhesive. First tape 40 is affixed to bottom surface 38 beneath first top section 34. Second tape 44 is affixed to bottom surface 38 beneath second top section 35. First tape 40 is a double sided tape with adhesive on both sides so that first adhesive surface 41 of first tape 40 is covered with an adhesive compound such as glue, paste or rubber cement so that when pressed against bottom surface 38 of first cover 30 first tape 40 will be fixedly attached to first cover 30. Second adhesive side 42 of first tape 40 also has adhesive covering second adhesive side 42. Adhesive on second adhesive side 42 can be covered with removable foil or paper which can be peeled off prior to installation of first cover 30 to threshold 10. Likewise, second tape 44 is double sided tape with adhesive on both sides so that third adhesive side 45 of second tape 44 is covered with an adhesive compound such as glue, paste or rubber cement so that when pressed against bottom surface 38 of first cover 30 second tape 44 will be attached to first cover 30. Fourth adhesive side 46 of second tape 44 also has adhesive covering fourth adhesive side 46. Adhesive on fourth adhesive side 46 can be covered with removable foil or paper which can be peeled off prior to installation of first cover 30 to threshold 10.

First tape 40 and second tape 44 can be any width or length. Standard double sided adhesive tape of ½ inch width can be used. Second tape 44 is optional and is not necessary to secure first cover 30.

First cover 30 is installed on threshold 10 by removing any paper or foil to expose adhesive on second adhesive side 42 of first tape 40 and fourth adhesive side 46 of second tape 44, aligning cover 30 with threshold 10 and lowering cover 30 onto threshold 10 so that front flange 31 contacts front edge 11 of threshold 10 and rear flange 33 contacts rear edge 12 of threshold 10. Pressing down manually on first top section 34 will engage adhesive from second adhesive side 42 to main step 16 of threshold 10. Pressing down manually on top section 35 will engage adhesive from fourth adhesive side 46 to door step 18 of threshold 10.

First cover 30 can be manufactured economically in varying widths and lengths by using removable die sections. In the preferred embodiment, first cover 30 is manufactured using injection molding. However, first cover 30 may also be manufactured by heat molding from a single sheet of plastic or by stamping a single sheet of metal.

Figure 2:
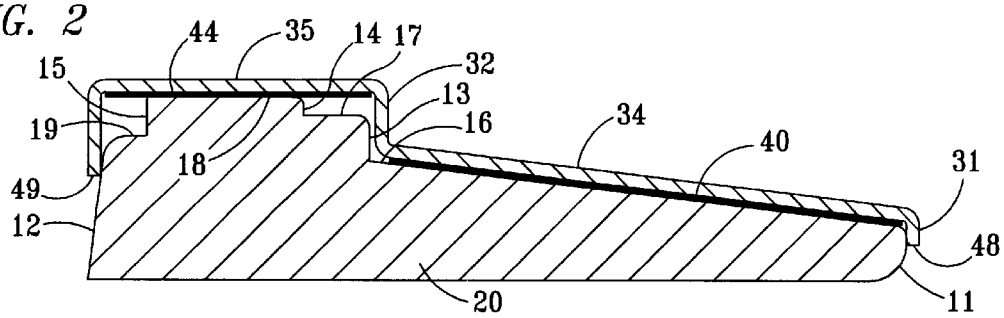
FIG. 2 is a side view of the doorway threshold with the apparatus in position on the threshold.

FIG. 2 is a side view of first cover 30 installed on threshold 10 showing the contact between first tape 40, second tape 44 and main step 16 and door step 18 of threshold 10.

Figure 3:
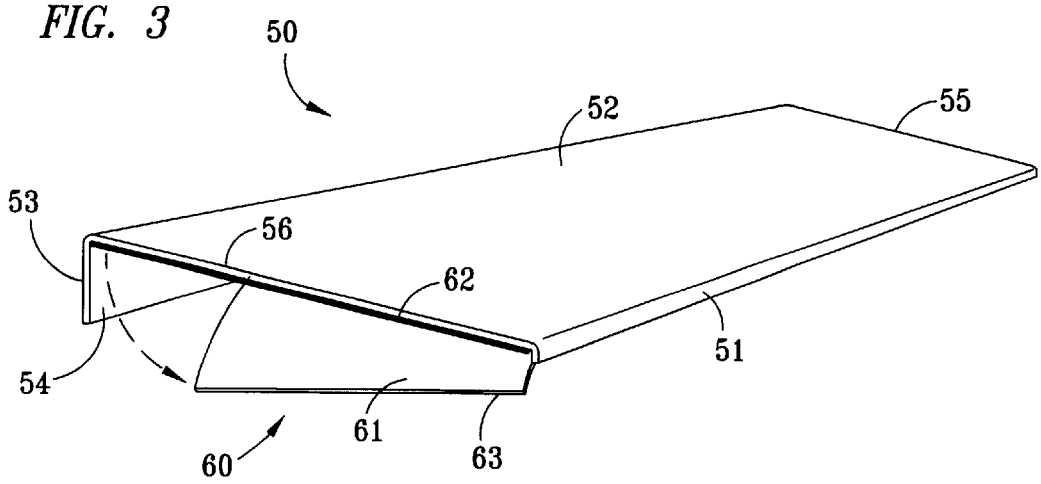
FIG. 3 is a side perspective of a second embodiment of the invention.

FIG. 3 depicts another embodiment of the apparatus in second cover 50 with surface 52 and third tape 60. Second cover 50 is meant for use on doorsills which do not have a multi-layered section beneath the door as shown in FIG. 1 and FIG. 2 for threshold 10. Second cover 50 can be used on doorsills that vary in construction or design from threshold 10. Second cover 50 has front section 51, rear section 53, top 52 and undersurface 54. Third tape 60 is affixed to second cover 50 by adhesive and is attached to undersurface 54 beneath top 52. Second cover 50 is of uniform thickness of 0.094 inches throughout. Second cover 50 can be of thickness between 1/16 inch to ¼ inch. Front section 51 extends 0.233 inches from second cover first end 58 until it becomes top 52. The radius of curvature between front section 51 and top 52 is 0.125 inches. The angle between front section 51 and top 52 is 14 degrees. Top 52 extends for 6 inches until it becomes rear section 53. Rear section 53 extends for 0.75 inch until it terminates in second cover second end 59. The radius of curvature between rear section 53 and top 52 is 0.125 inches. The angle between rear section 53 and top 52 is 104 degrees. The overall width of second cover 50 from front 51 to rear 53 is 6.188 inches. The length of second cover 50 measured from second cover left edge 56 to second cover right edge 55 is 35 inches for second cover 50's manufactured for front door thresholds and 31 inches for second cover 50's manufactured for garage door, rear door and utility door thresholds. However, the length of second cover 50 can be as much as 48 inches for custom doors. The width of second cover 50 measured from front section 51 to rear section 53 can vary. For front door threshold's the width of second cover 50 can vary from 3 inches to 10 inches. For garage door, rear door and utility door thresholds, the width of second cover 50 can vary from 2 inches to 6 inches. The height of front section 51 can vary from ⅛ inch to ½ inch. The height of rear section 53 can vary from ¼ inch to 2 inches.

Second cover 50 can function to protect the threshold by aligning second cover 50 above threshold 10 and lowering second cover 50 onto threshold 10 so that front flange 31 contacts front edge 11 of threshold 10 and rear flange 33 contacts rear edge 12 of threshold 10. Second cover 50 will be held in place by gravity.

Second cover 50 can be made more secure by means of adhesive. Third tape 60 is affixed to undersurface 48 beneath top 52. Third tape 60 is double sided tape with adhesive on both sides so that cover side 61 of third tape 60 and threshold side 63 of tape 60 are covered with an adhesive compound such as glue, paste or rubber cement so that when cover side 61 of third tape 60 is pressed against bottom surface 54 of second cover 50 third tape 60 will be fixedly attached to undersurface 54 of second cover 50. Threshold side 63 of second tape 60 also has adhesive covering threshold side 63.

Adhesive on threshold side 63 can be covered with removable foil or paper which can be peeled off prior to installation of second cover 50 to threshold 10 or to any threshold.

Second cover 50 can be used in place of first cover 30 for application to threshold 10 or to a threshold 10 without first minor step 17, door step 18, second minor step 19 first face 13, second face 14 and third face 15. In such a threshold 10 main step 16 will continue to meet rear edge 12. Second cover 50 is installed by exposing adhesive on threshold side 63 of third tape 60, aligning second cover 50 above threshold 10 and lowering second cover 50 onto threshold 10 so that front section 51 contacts front edge 11 and rear section 53 contacts rear edge 12. By pressing down on top 53, adhesive on threshold side 63 of third tape 60 will contact main step 16. Cover 50 is flexible and so can conform to variations in threshold 10. If door step 18 is present in threshold 10 then pressing down on top 53 will also bring adhesive on threshold side 63 of third tape 60 in contact with door step 18.

Figure 4:
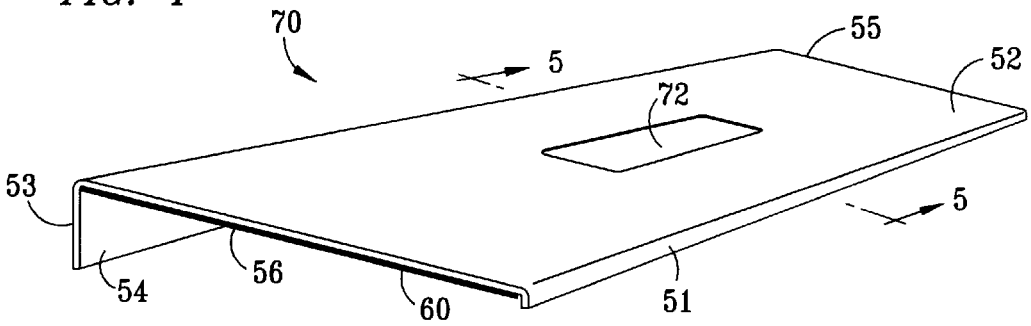
FIG. 4 is a side perspective the second embodiment of the invention with a recess cavity for advertising.

FIG. 4 depicts second cover 50 with recessed space 72. Recessed space 72 functions to allow advertising such as the builders name to be inserted in recessed space 72 by means of single side adhesive tape with advertising printed on the non-adhesive side. The recess protects the advertising from some abrasion. Recessed space has a maximum depth equal to ½ the thickness of second cover 50, a maximum width of ⅓ the width of second cover 50 and a maximum length of ⅓ the length of second cover 50. In place of recess space 72, raised lettering may be printed during the manufacture in order to provide identifying and instructional information.

Figure 5:
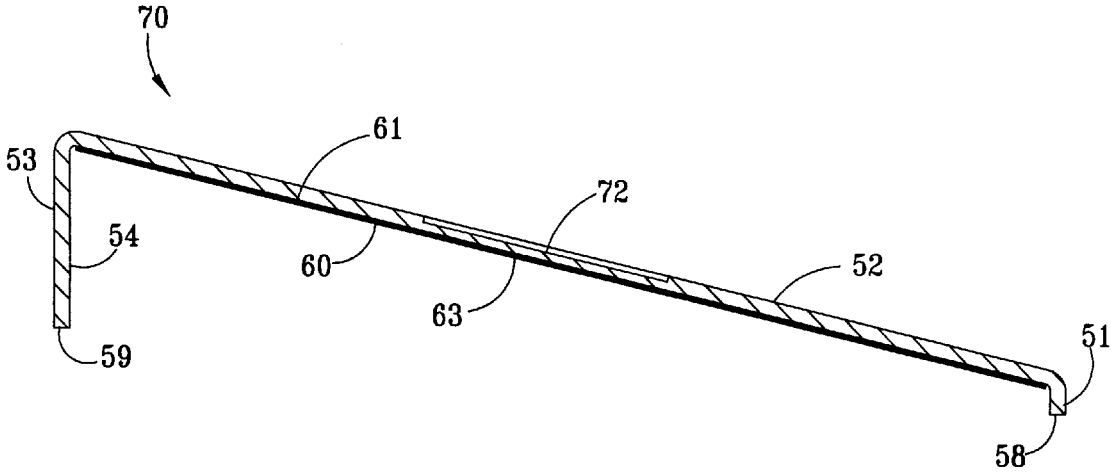
FIG. 5 is a cross sectional view along line 80 of the apparatus of FIG. 4.

FIG. 5 is a cross sectional view along line 80 showing third tape 60 and recessed space 72.

Those skilled in the art should appreciate that the conception and the specific embodiment disclosed may be readily utilized as a basis for modifying or designing other structures for carrying out the same purposes of the present invention. Those skilled in the art should also realize that such equivalent constructions do not depart from the spirit and scope of the invention as set forth in the appended claims. Other alternatives and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed:

1. A cover and threshold combination comprising:

a cover having a front flange, a rear flange, a first top section, a vertical section, a second top section, and an undersurface;

a threshold having a front edge, a rear edge, a main step and a door step;

a means for adhering said cover to the threshold;

wherein said undersurface contacts the main step and the door step.

2. The cover and threshold combination of claim 1 wherein the front flange is vertical and abuts the front edge.

3. The cover and threshold combination of claim 1 further comprising a plurality of second tapes adhesively attached to the undersurface and to the door step.

4. The cover and threshold combination of claim 1 further comprising a first tape adhesively attached to the undersurface and to the main step.

5. The cover and threshold combination of claim 1 further comprising a plurality of first tapes adhesively attached to the undersurface and to the main step.

6. The cover and threshold combination of claim 1 further comprising a second tape adhesively attached to the undersurface and to the door step.

7. A cover for protection of a threshold having a front edge, a rear edge, a main step and a door step, said cover comprising a front flange, a rear flange, a first top section, a vertical section, a second top section and an undersurface wherein the front flange is vertical and is adapted to contact the front edge and the rear flange is adapted to contact the rear edge;

a first tape adhesively attached to the undersurface;

wherein said undersurface is adapted for removable attachment to the threshold by adhesion of the first tape to the main step.

8. The cover of claim 7 further comprising a left edge and a right edge wherein the distance between the left edge and the right edge is from 31 inches to 48 inches.

9. The cover of claim 7 further comprising a second tape adhesively attached to the undersurface and wherein the undersurface is adapted for removable attachment to the threshold by adhesion of the second tape to the door step.

10. The cover of claim 7 wherein the distance between the front flange and the rear flange is in the range of from 2 to 10 inches.

11. A threshold and cover combination comprising:

a threshold having a front edge, a rear edge, a door step and a main step;

a cover having a top surface, a bottom surface, a front section, and a rear section wherein the front section contacts the front edge and the rear section is engages the rear edge; and an adhesive means for removably attaching the bottom surface to the door step and the main step.

12. The combination of claim 11 wherein the top surface contains a recessed cavity.

13. The combination of claim 11 further comprising a double sided tape adhesively affixed to the bottom surface.

14. The combination of claim 11 further comprising a plurality of double sided tapes adhesively affixed to the bottom surface.

15. The combination of claim 11 wherein the distance from the front flange to the rear flange is in the range of from 2 to 10 inches.

16. The combination of claim 11 further comprising a left edge and a right edge wherein the distance between the left edge and the right edge is from 31 to 48 inches.

* * * * *